US009951524B2

(12) United States Patent
Mazzarelli

(10) Patent No.: US 9,951,524 B2
(45) Date of Patent: Apr. 24, 2018

(54) RETRACTABLE AWNING

(71) Applicant: Samuel Mazzarelli, Goshen, CT (US)

(72) Inventor: Samuel Mazzarelli, Goshen, CT (US)

( * ) Notice: Subject to any disclaimer, the term of this patent is extended or adjusted under 35 U.S.C. 154(b) by 0 days.

(21) Appl. No.: 15/176,302

(22) Filed: Jun. 8, 2016

(65) Prior Publication Data

US 2016/0356085 A1 Dec. 8, 2016

Related U.S. Application Data

(60) Provisional application No. 62/172,457, filed on Jun. 8, 2015.

(51) Int. Cl.

| | |
|---|---|
| ***A47G 5/02*** | (2006.01) |
| ***A47H 1/00*** | (2006.01) |
| ***E04F 10/06*** | (2006.01) |

(52) U.S. Cl.

CPC ..... *E04F 10/0659* (2013.01); *E04F 10/0607* (2013.01); *E04F 10/0648* (2013.01)

(58) Field of Classification Search

CPC ..... E04F 10/0607; E04F 10/0648; E04F 10/0659; E06B 2009/405; E06B 2009/585; E06B 2009/587; E06B 2009/588; E06B 9/40; E06B 9/44; E06B 9/42; E06B 9/56; E06B 9/58; E06B 9/581

See application file for complete search history.

(56) References Cited

U.S. PATENT DOCUMENTS

| | | | | |
|---|---|---|---|---|
| 2,354,832 A * | 8/1944 | Ristine | A47H 2/02 160/11 |
| 4,825,921 A * | 5/1989 | Rigter | E06B 9/54 160/23.1 |
| 5,547,009 A * | 8/1996 | Plumer | E06B 9/70 160/265 |
| 5,947,544 A * | 9/1999 | Hubeshi | B60J 1/2019 160/23.1 |
| 9,072,200 B2 * | 6/2015 | Dersch | H05K 7/20745 |

OTHER PUBLICATIONS

Polypropylene, Wikipedia, available May 8, 2016; accessed on Jul. 7, 2017 from https://en.wikipedia.org/w/index.php?title=Polypropylene&oldid=719178534.*

Vinyl the Material for Life, available Mar. 28, 2016; accessed on Jul. 7, 2017 from https://web.archive.org/web/20160328145029/http://www.vinylinfo.com/vinyl/facts.*

* cited by examiner

*Primary Examiner* — Blair M Johnson
*Assistant Examiner* — Jeremy C Ramsey
(74) *Attorney, Agent, or Firm* — Cantor Colburn LLP

(57) ABSTRACT

In an embodiment, a retractable awning comprises a slotted track; a webbing disposed in the slotted track; a cover attached to the webbing and disposed on the slotted track; a first roller disposed at a first end of the slotted track and connected to a first end of the webbing; a second roller disposed at a second opposite end of the slotted track and connected to a second end of the webbing; and a bracket, the bracket disposed over the first roller and comprising a guide roller which contacts the cover when the retractable awing is in a deployed position between the first roller and the first end of the slotted track.

20 Claims, 6 Drawing Sheets

RETRACTABLE AWNING

CROSS-REFERENCE TO RELATED APPLICATION

This application claims the benefit of U.S. Provisional Patent Application Ser. No. 62/172,457 filed Jun. 8, 2015. The related application is incorporated herein in its entirety by reference.

BACKGROUND (1) Field

Disclosed is a retractable awning. The awning is suitable for reversibly covering a pergola, for example.

(2) Description of the Related Art

Outdoor venues are desirable for many events, such as weddings and graduations, and present the challenge of how to accommodate adverse weather. Thus, there remains a need for a way to provide a deployable covering over large events that can be provided without disturbing the event if adverse weather develops.

SUMMARY

Disclosed is a retractable awning including: a slotted track; a webbing disposed in the slotted track; a cover attached to the webbing and disposed on the slotted track; a first roller disposed at a first end of the slotted track and connected to a first end of the webbing; a second roller disposed at a second opposite end of the slotted track and connected to a second end of the webbing; and a bracket, the bracket disposed over the first roller and including a guide roller which contacts the cover between the first roller and a first end of the slotted track.

Also disclosed is a retractable awning system, the system including: a first retractable awning; a second retractable awning disposed adjacent to the first retractable awning; and a membrane connecting a cover of the first retractable awning to a cover of the second retractable awning, wherein each of the first retractable awning and the second retractable awning includes a slotted track, a webbing disposed in the slotted track, a cover attached to the webbing and disposed on the slotted track, a first roller disposed at a first end of the slotted track and connected to a first end of the webbing, a second roller disposed at a second opposite end of the slotted track and connected to a second end of the webbing, and a bracket, the bracket disposed over the first roller and including a guide roller which contacts the cover between the first roller and a first end of the slotted track.

Also disclosed is a method of deploying an awning, the method including: providing a retractable awning including a slotted track, a webbing disposed in the slotted track, a cover attached to the webbing and disposed on the slotted track, a first roller disposed at a first end of the slotted track and connected to a first end of the webbing, a second roller disposed at a second opposite end of the slotted track and connected to a second end of the webbing, and a bracket, the bracket disposed over the first roller and including a guide roller which contacts the cover between the first roller and a first end of the slotted track; and turning the second roller to unwind the cover and deploy the awning.

Also disclosed is a retractable awning comprising: a first outer slotted track; a second outer slotted track; a middle slotted track between the first outer slotted track and the second outer slotted track; a first webbing disposed in the first outer slotted track; a second webbing disposed in the second outer slotted track; a middle webbing disposed in the middle slotted track; a cover attached to each of the first, second, and middle webbings and disposed on each of the first outer, second outer, and middle slotted tracks; a first roller disposed at a first end of the first outer, second outer, and middle slotted tracks and connected to a first end of the first, second, and middle webbings; a second roller disposed at a second opposite end of the first outer, second outer, and middle slotted tracks and connected to a second end of the first, second, and middle webbings; a first outer bracket disposed on the first webbing and comprising a first guide roller, wherein the first guide roller is angled away from the center of the retractable awning; a second outer bracket disposed on the second webbing and comprising a second guide roller, wherein the second guide roller is angled away from the center of the retractable awning; a middle bracket disposed on the middle webbing and comprising a middle guide roller, wherein the middle guide roller is aligned with the retractable awning; and a motor configured to wind and unwind the retractable awning.

BRIEF DESCRIPTION OF THE DRAWINGS

The above and other aspects, advantages, and features of this disclosure will become more apparent by describing in further detail exemplary embodiments thereof with reference to the accompanying drawings, in which.

DETAILED DESCRIPTION

Disclosed is a retractable awning comprising: a slotted track; a webbing disposed in the slotted track; a cover attached to the webbing and disposed on the slotted track; a first roller disposed at a first end of the slotted track and connected to a first end of the webbing; a second roller disposed at a second opposite end of the slotted track and connected to a second end of the webbing; and a bracket, the bracket disposed over the first roller and comprising a guide roller which contacts the cover when the retractable awing is in a deployed position between the first roller and a first end of the slotted track.

Figure 1A:
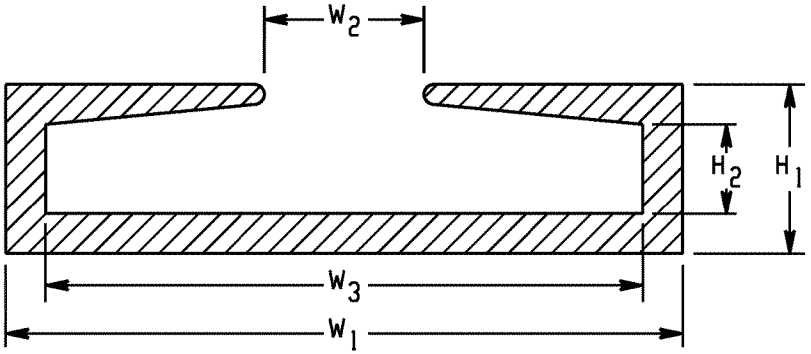
FIG. 1A is an embodiment of a cross-section view of an embodiment of the slotted track.
Figure 1B:
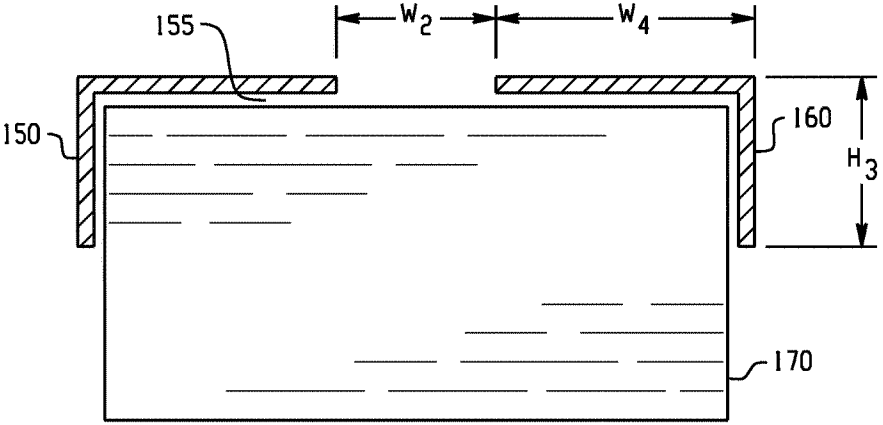
FIG. 1B is a cross-section view of another embodiment of the slotted track.

The slotted track may have a slotted cross-section as shown in FIG. 1A or 1B, and may have any suitable length, wherein the length may be selected based on the desired dimensions of the awning. The slotted track of FIG. 1A may be mounted on a third portion. As shown in FIG. 1A, the slotted track may have an overall width $W_1$, a slot width $W_2$, and inner width $W_3$, an overall height $H_1$, and an inner height $H_2$. The inner height $H_2$ may be constant or may be varied. For example, the inner height may increase from an outer edge of the slotted track to the slot edge. The overall width $W_1$ may be 6 millimeters (mm) to 110 mm, 10 mm to 100 mm, or 15 mm to 80 mm. The slot width $W_2$ may be 2 mm to 25 mm, 4 mm to 20 mm, or 6 mm to 15 mm. The inner width $W_3$ may be 4 mm to 100 mm, 6 mm to 90 mm, or 8 mm to 80 mm. The overall height $H_1$ may be 10 mm to 100 mm, 15 mm to 90 mm, or 20 mm to 80 mm. The inner height $H_2$ may be 8 mm to 90 mm, 15 mm to 80 mm, or 20 mm to 70 mm.

Figure 5:
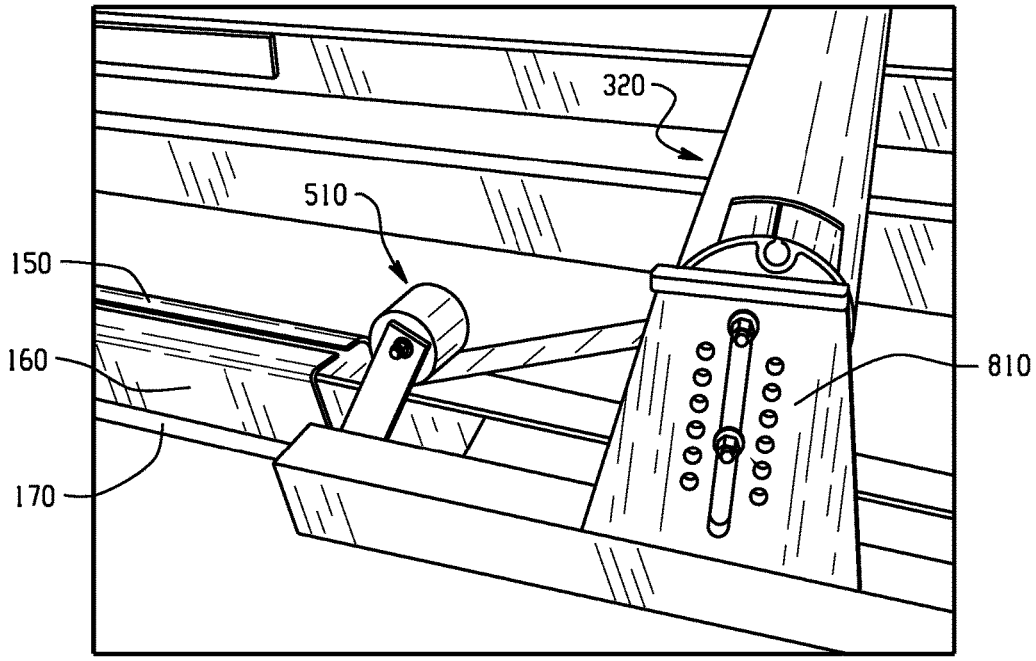
FIG. 5 shows an embodiment of a second roller and a webbing guide.

As illustrated in FIG. 1B, the slotted track may comprise a first portion 150 and a second portion 160, each of which independently may have a C shape or an L shape as illustrated in FIG. 1B and in FIG. 5. A third portion 170 may be disposed between the first portion and the second portion. The first portion 150 and the second portion 160 may be connected as a single track piece while allowing for the slot opening and the third portion 170 may be disposed therein the single track piece. In order to accommodate the webbing, a webbing gap 155 may be located in between the first portion and the third portion and also between the second portion and the third portion. The first portion and the second portion may each independently have a width $W_4$ and a height $H_3$, wherein the width $W_4$ may be 10 mm to 250 mm, 20 mm to 200 mm, or 30 mm to 150 mm, and wherein the height $H_3$ may be 10 mm to 250 mm, 20 mm to 200 mm, or 30 mm to 150 mm. The third portion 170 may have any suitable size, and may be selected to have any suitable dimensions.

The slotted track may comprise any suitable material, and may comprise a metal (such as aluminum, steel, or a corrosion resistant steel) a synthetic polymeric material (such as polypropylene, polyethylene, a polyamide such as nylon, polycarbonate, acrylic, polyethylene terephthalate), wood, or a combination thereof. The first portion, the second portion, and the third portion may each independently comprise any suitable material, and may comprise a metal (such as aluminum, steel, or a corrosion resistant steel) a synthetic polymeric material (such as polypropylene, polyethylene, a polyamide such as nylon, polycarbonate, acrylic, polyethylene terephthalate), wood, or a combination thereof. For example, the first and second portions may comprise a metal and the third portion may comprise wood or a synthetic polymeric material.

The webbing is selected to fit within the slotted track. The webbing may have a width of 3 mm to 90 mm, 5 mm to 85 mm, 10 mm to 80 mm, or 20 mm to 70 mm, and may have a thickness of 1 mm to 5 mm, 1.5 mm to 4.5 mm, 2 mm to 4 mm, or 3 mm. The webbing may comprise a polyamide such as nylon, polypropylene, polyester, or a combination thereof.

The cover comprises any suitable material, and may comprise an olefin such as polyester or polypropylene, cotton, rayon, a polyamide such as nylon, acrylic, polyethylene terephthalate, polyurethane, vinyl, or a combination thereof. The cover is connected to the webbing in a direction parallel to the length of the slotted track so that the webbing may ride within the slotted track while the cover rides on the slotted track. The cover may be attached to the webbing with thread, an electro-seal, a weld such as a heat weld, an adhesive weld, a sonic weld, or a combination thereof. A sewn connection is specifically mentioned. The cover, when in a deployed configuration, is on the slotted track.

Figure 2A:
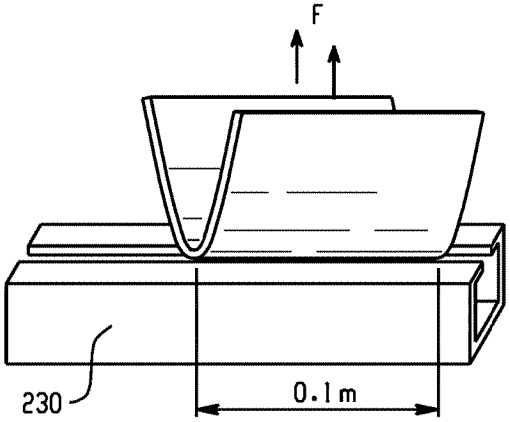
FIG. 2A shows a section of webbing in a slotted track for a pull test.
Figure 2B:
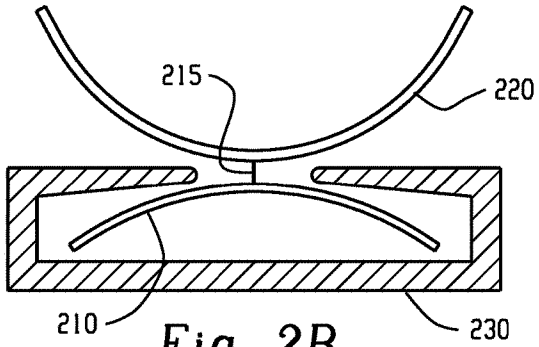
FIG. 2B illustrates a schematic diagram of an embodiment of a cross-section of webbing inserted in a slotted track for a pull test.

It has been surprisingly discovered that certain combinations of webbing and slotted track dimensions provide improved performance. Slotted tracks having a larger slot width $W_2$ are best used with a webbing having a greater latitudinal stiffness, and webbing having less latitudinal stiffness may be used if a slotted track having a narrower slot width $W_2$ is provided. A suitable combination of webbing and slotted track may be defined based on a pull test, in which a 0.1 meter (m) section of webbing is connected to a cover, the webbing disposed in the slot and the cover on the slotted track, and the cover pulled in a direction perpendicular to the slot until the webbing is pulled through the slot. It has been discovered that use of a webbing and slot combination in which the webbing is retained within the slot when the cover is pulled with a force, F, of 30 newtons (N) force perpendicular to the slot provides improved results. In an embodiment, the webbing and slot combination provides a pull resistance of 30 N to 200 N, 40 N to 150 N, or 50 N to 125 N, when determined by pulling a cover attached to a 0.1 m section of webbing in a direction perpendicular to the slot until the webbing is pulled through the slot. An illustration of a pull test is illustrated in FIG. 2A, which shows a section of webbing 210 sewn to a cover 220 and the webbing inserted into a slotted track 230, and FIG. 2B, which is a schematic diagram of an embodiment of a section of webbing 210 sewn into a cover 220 by thread 215 and inserted into a slotted track 230. As shown in FIG. 2B, the webbing is located within the slot of the slotted track and is attached to the cover to 220. In the pull test, load, F, is added to the cover until the webbing pulls out of the track.

Figure 3:
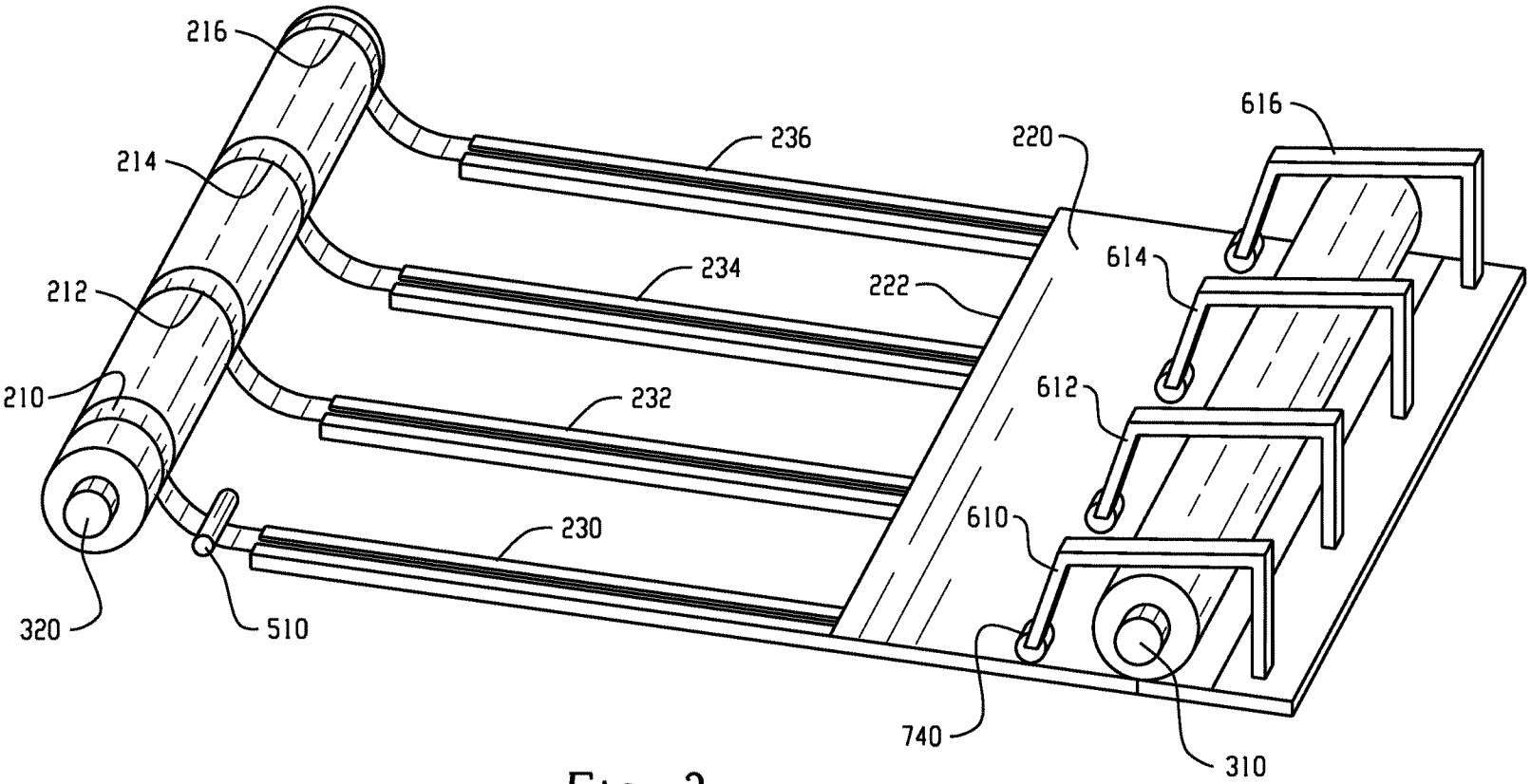
FIG. 3 shows an embodiment of the retractable awning.

The retractable awning comprises a first roller 310 disposed in a first end of the slotted track, and a second roller 320 disposed at a second opposite end of the slotted track, as shown in FIG. 3. An end of the first roller 310 is shown in further detail in FIG. 4, and an end of the second roller 320 is shown in further detail in FIG. 5. When in a retracted configuration, the first roller 310 holds the rolled cover. When the awning is deployed, the second roller takes up the webbing, which is connected to the cover, to pull the cover over the slotted track. A motor may be connected to one or both of the first roller 310 and the second roller 320. In an embodiment, a first motor connected to the first roller 310 and a second motor is connected to the second roller 320. The first motor and the second motor may be controlled by a controller so that they operate in synchrony. Also, the controller may operate the first motor and the second motor so that a suitable tension is maintained on the webbing.

In order to maintain a tension of the webbing, one or both of the first roller 310 and the second roller 320 may each independently be raised relative to a height of the slotted track. The webbing in the slotted track and the webbing between a guide and a roller may be at a rolling angle of 0 to 60°, or 20 to 50°. In order to achieve the rolling angle, one or both of the first roller 310 and the second roller 320 may mounted on an adjustable mount 810, for example, as illustrated in FIG. 4 and FIG. 5.

Depending on the desired width of the awning, a plurality of slotted tracks may be provided. For example, shown in FIG. 3 is a first outer slotted track 230 and an opposite second outer slotted track 236. Also provided are inner slotted tracks 232 and 234 disposed between the first outer slotted track 230 and the second outer slotted track 236. The number of slotted tracks may be 2 to 50, 3 to 45, 4 to 40, or 5 to 30.

Figure 10:
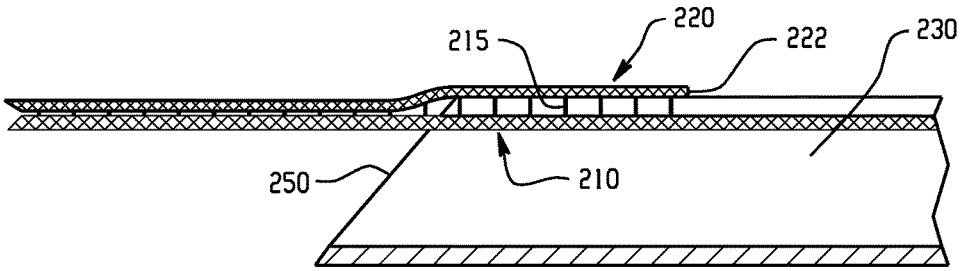
FIG. 10 shows an embodiment of a slotted track with an angled edge.
Figure 11:
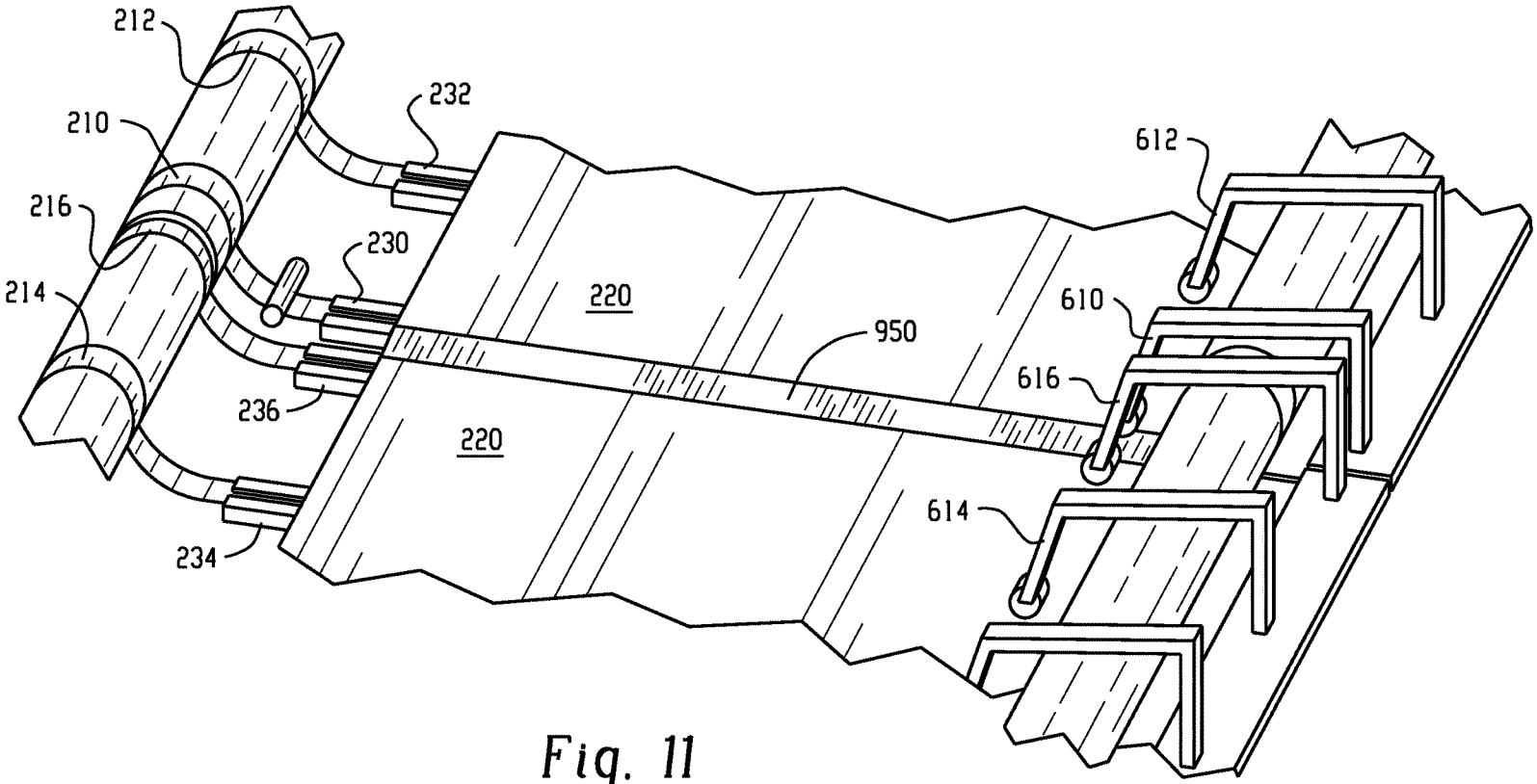
FIG. 11 shows an embodiment of a retractable awing system comprising a first retractable awning and a second retractable awning.

The slotted track may have an angled leading edge 250, for example, as illustrated in FIG. 10. The angled leading edge 250 may help guide the cover leading edge 222 to the upper surface of the slotted track 230. The angle's leading edge may be at an edge angle of 5 to 85°, or 20 to 50° relative to the upper surface of the slotted track.

Figure 4:
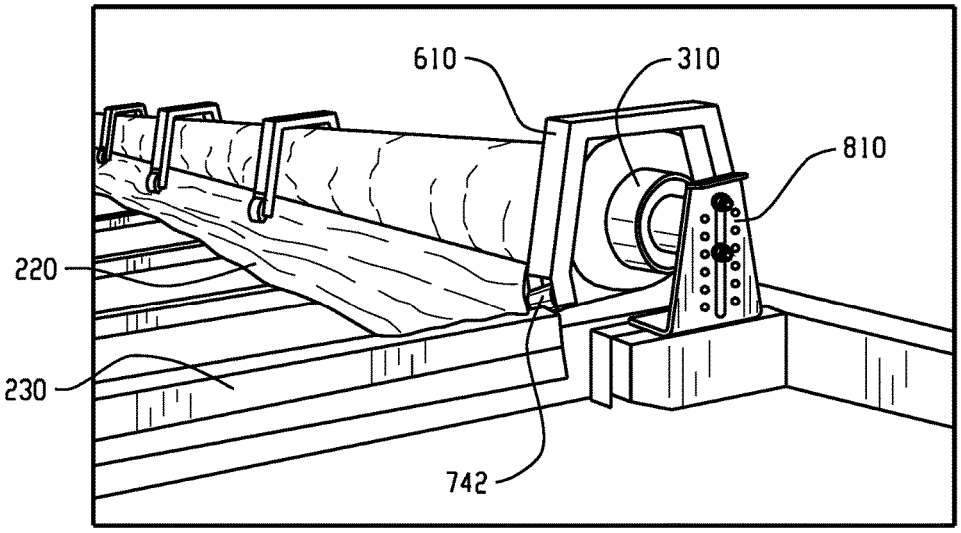
FIG. 4 shows an embodiment of a bracket and an angled guide roller.
Figure 6:
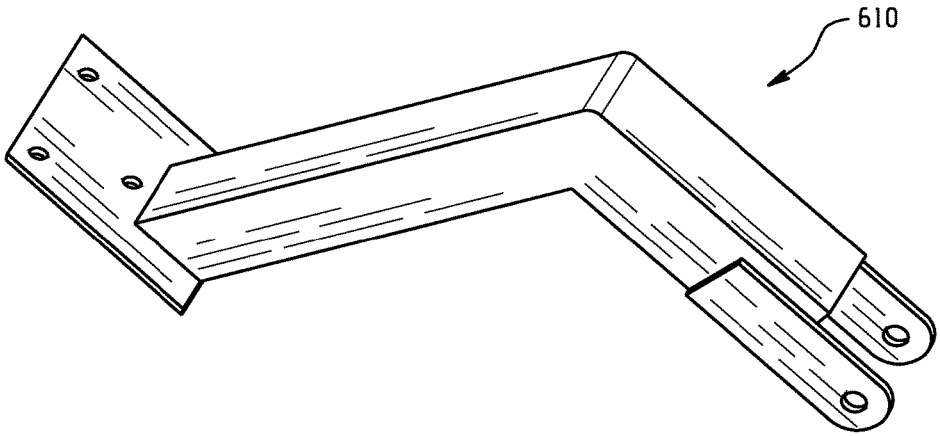
FIG. 6 shows an embodiment of an alternative design of a bracket.

Also disclosed is a bracket 610 to guide the webbing where the webbing enters the track, as shown in FIG. 3 and FIG. 4. As shown in FIG. 3, the bracket may comprise a first outer bracket 610, a second outer bracket 616, and inner brackets 612 and 614. In an embodiment, a bracket is disposed on each slotted track. An alternative bracket, for wall mounting, is shown in FIG. 6.

Figure 9:
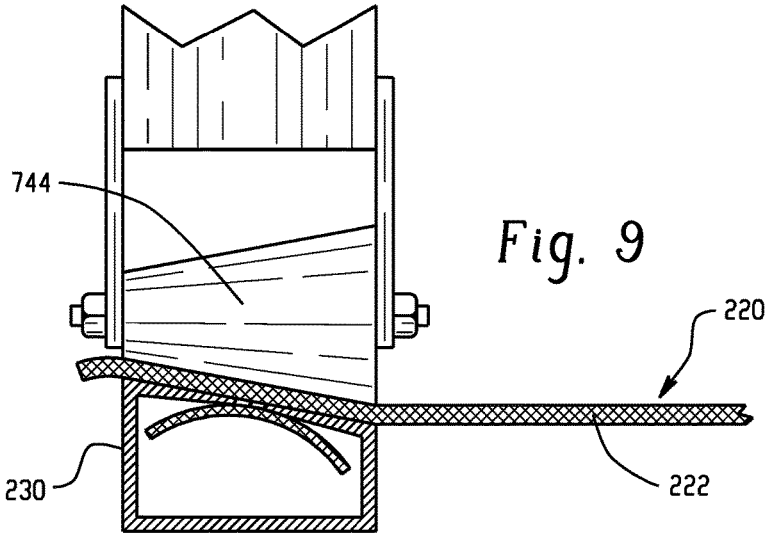
FIG. 9 shows an embodiment of a slanted guide roller.

Each bracket may comprise a guide roller 740. The guide roller is disposed on the cover and on the webbing, so as to guide the webbing into and out of the slotted track. It has been discovered that by angling the guide roller or by utilizing a slanted guide roller on the outer brackets towards an outer edge of the awning, departure of the webbing from the slotted track is avoided and wrinkles in the cover are reduced. An angled guide roller 742 is shown in FIG. 4 and a slanted guide roller 744 is shown in FIG. 9. In an embodiment, the angled guide roller is angled away from the center of the retractable awning. For example, the angled guide roller may be angled at an angle of 2° to 45°, 4° to 35°, or 6° to 25° relative to an upper surface of the slotted track. The upper surface of the slotted track 230 may conform to the surface of the angled guide roller as is illustrated in FIG. 9. The slanted guide roller 744 may have a large roller end with a maximum diameter and a small roller end with a minimum diameter, wherein the small roller end may be facing away from a center of the cover and towards an outer edge of the cover.

Also provided, as shown in FIG. 5, is a webbing guide 510 between the slotted track and the second roller. The guide guides the webbing between the slotted track and the second roller. The webbing guide may be aligned with, for example, parallel to a surface of the webbing. Alternatively, a bracket 610, as shown in FIG. 6, may be used instead of the webbing guide 510, or a combination of the guide and the bracket may be used. In an embodiment, the bracket over the second roller 320 may comprise an outer bracket on either side of a middle bracket, wherein brackets over the second roller are as disclosed for the first outer bracket 610, the second outer bracket 616, and the middle brackets 612 and 614.

Figure 7:
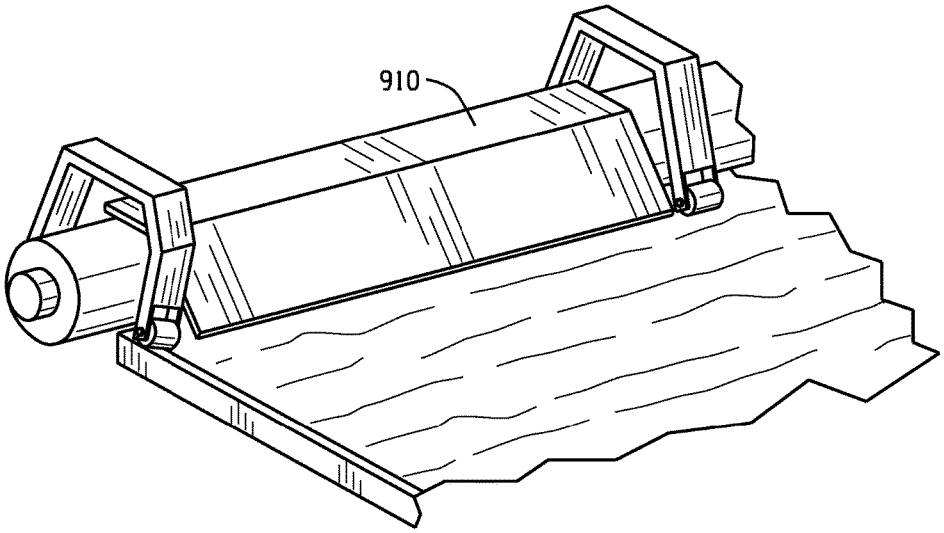
FIG. 7 shows an embodiment of a shield.
Figure 8:
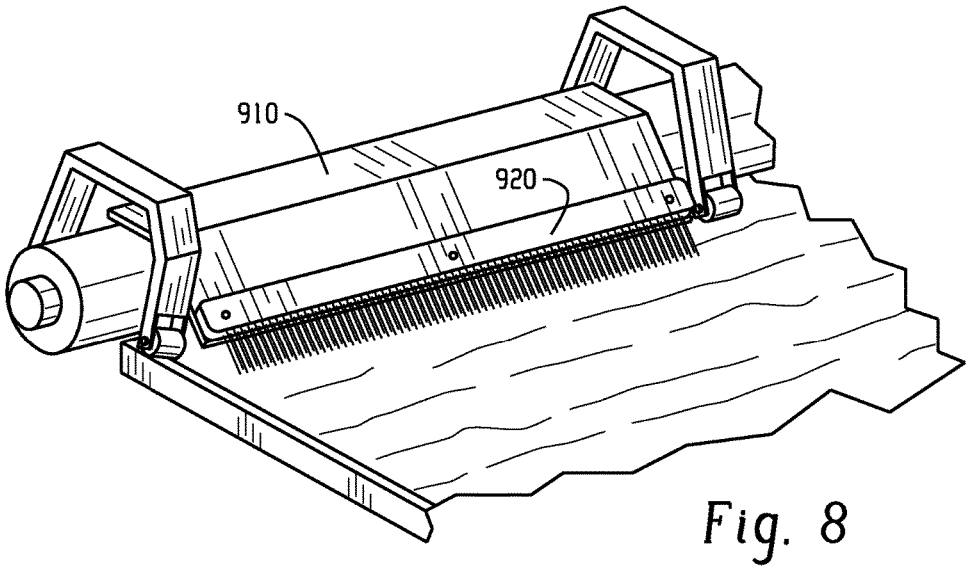
FIG. 8 shows an embodiment of a brush.

In addition, disclosed is a shield 910, for example, as shown in FIG. 7. The shield may be disposed in between two brackets as illustrated in FIG. 7 or may be disposed on a bracket or brackets to protect the one or both of the roller and the bracket. The shield may provide improved ornamental appearance. A shield edge may be at an angle relative to the first roller to direct any debris to an outer edge and potentially off of the cover. In addition, a brush 920, for example, as shown in FIG. 8 may be provided to sweep away any debris which may be on the cover to keep debris from being entrained within the rolled up cover. The brush may be disposed in between two brackets as illustrated in FIG. 8 or may be disposed on a bracket or brackets to protect the one or both of the roller and the bracket. A brush edge may be at an angle relative to the first roller to direct any debris to an outer edge and potentially off of the cover.

Also disclosed is a retractable awning system, the system comprising: a first retractable awning; a second retractable awning disposed adjacent to the first retractable awning; and a membrane connecting a cover of the first retractable awning to a cover of the second retractable awning, wherein each of the first retractable awning and the second retractable awning each comprise a slotted track, a webbing disposed in the slotted track, a cover attached to the webbing and disposed on the slotted track, a first roller disposed at a first end of the slotted track and connected to a first end of the webbing, a second roller disposed at a second opposite end of the slotted track and connected to a second end of the webbing, and a bracket, the bracket disposed over the first roller and comprising a guide roller which contacts the cover when the retractable awing is in a deployed position between the first roller and the first end of the slotted track.

The membrane may comprise any suitable material and may comprise, for example, an olefin (such as polyester or polypropylene), cotton, rayon, a polyamide (such as nylon), an acrylic, polyethylene terephthalate, a polyurethane, a vinyl, or a combination thereof. The membrane may be connected to the adjacent covers to provide a seamless and leakproof transition between adjacent covers.

Also disclosed is a method of deploying an awning, the method comprising: providing a retractable awning comprising a slotted track, a webbing disposed in the slotted track, a cover attached to the webbing and disposed on the slotted track, a first roller disposed at a first end of the slotted track and connected to a first end of the webbing, a second roller disposed at a second opposite end of the slotted track and connected to a second end of the webbing, and a bracket, the bracket disposed over the first roller and comprising a guide roller which contacts the cover when the retractable awing is in a deployed position between the first roller and a first end of the slotted track; and turning the second roller to unwind the cover and deploy the awning. The first and second rollers may each individually be turned by any suitable means, such as a handcrank or a motor, for example. Use of electric motors disposed within each roller is specifically mentioned. The motors may be controlled by a controller, which directs the first motor and the second motor to turn the first roller and the second roller to deploy the awning. In an embodiment, the controller maintains a suitable tension on the webbing while the awning is being deployed and retracted. The controller may be actuated by a switch, enabling a user to automatically deploy or retract the awning as desired.

Also disclosed is a pergola system, the pergola system comprising a pergola, and the retractable awning disposed on the pergola. When the cover is retracted, the pergola system permits having an outdoor event in the pergola. If desired, such as when adverse weather is indicated, the cover may be deployed by actuating the controller, permitting the event to continue under the protection of the deployed cover.

The invention has been described with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

What is claimed is:

1. A retractable awning comprising: a slotted track; at webbing disposed in the slotted track; a cover attached to the webbing and disposed on the slotted track; a first roller disposed at a first end of the slotted track and connected to a first end of the webbing; a second roller disposed at a second opposite end of the slotted track and connected to a second end of the webbing; and a bracket, the bracket disposed over the first roller and comprising a guide roller which contacts the cover when the cover is in a deployed position between the first roller and the first end of the slotted track.

2. The retractable awning of claim 1, wherein the slotted track and the webbing provide a pull resistance of at least 30 newtons, wherein the pull resistance is determined by pulling a 0.1 meter long section of webbing from the slotted track having a slot with a slot width in a direction perpendicular to a longitudinal axis of the slot.

3. The retractable awning of claim 1, wherein the slotted track has a slot width of 2 millimeters to 25 millimeters.

4. The retractable awning of claim 1, wherein the slotted track has an inner width, $w_3$, of 4 millimeters to 100 millimeters.

5. The retractable awning of claim 1, wherein the webbing has a width of 3 millimeters to 90 millimeters, and a thickness of 1 millimeter to 5 millimeters.

6. The retractable awning of claim 1, wherein the webbing comprises nylon, polypropylene, polyester, or a combination thereof.

7. The retractable awning of claim 1, wherein the cover is attached to the webbing with thread, an electro-seal, a weld or a combination thereof.

8. The retractable awning of claim 1, wherein the cover comprises an olefin, cotton, rayon, a polyamide, an acrylic polymer, polyethylene terephthalate, a polyurethane, a vinyl polymer, or a combination thereof.

9. The retractable awning of claim 1, wherein the webbing is attached to the second roller.

10. The retractable awning of claim 1, wherein the bracket is an outer bracket and the retractable awning further comprises an inner bracket, wherein a guide roller of the outer bracket is an angled guide roller angled away from a center of the retractable awning or is a slanted guide roller having a first roller end with a maximum diameter and a second roller end with a minimum diameter, wherein the second roller end is facing an outer edge of the cover, and wherein a guide roller of the inner bracket is aligned with a surface of the awning.

11. The retractable awning of claim 1, wherein the slotted track is a first outer slotted track and the retractable awning further comprises an inner slotted track, wherein the bracket is an outer bracket and the retractable awning further comprises an inner bracket, and wherein an outer guide roller of the outer bracket is on the first outer slotted track, and wherein an inner guide roller of the inner bracket is on the inner slotted track.

12. The retractable awning of claim 1, further comprising a shield disposed on the cover.

13. The retractable awning of claim 1, further comprising a brush disposed on the cover.

14. The retractable awning of claim 1, further comprising at least one motor configured to wind and unwind the retractable awning.

15. The retractable awning of claim 1, comprising a first motor connected to the first roller, and a second motor connected to the second roller.

16. The retractable awning of claim 15, further comprising a controller configured to actuate the first motor and the second motor to unwind or wind the retractable awning.

17. A retractable awning system, the system comprising:

a first retractable awning comprising the retractable awning of claim 1;

a second retractable awning disposed adjacent to the first retractable awning; and a membrane connecting the cover of the first retractable awning to a second awning cover of the second retractable awning, wherein the second retractable awning comprises second awning slotted track, second awning webbing disposed in the second awning slotted track, the second awning cover attached to the second awning webbing and disposed on the second awning slotted track, a first awning roller disposed at a first awning end of the second awning slotted track and connected to a first awing end of the second awning webbing, a second awning roller disposed at a second awning opposite end of the second awning slotted track and connected to a second awning end of the second awning webbing, and second awning bracket, the second awning bracket disposed over the first awning roller and comprising second awning guide roller which contacts the second awning cover when the second retractable awning is in a deployed position between the first awning roller and a first awing end of the second awning slotted track.

18. A method of deploying an awning, the method comprising:

providing the retractable awning of claim 1; and turning the second roller to unwind the cover and deploy the awning.

19. The method of claim 18, further comprising a first motor connected to the first roller;

a second motor connected to the second roller; and a controller, wherein the method further comprises actuating the controller to direct the first motor and the second motor to turn the first roller and the second roller to deploy the awning.

20. A retractable awning comprising:

a first outer slotted track;

a second outer slotted track;

a middle slotted track between the first outer slotted track and the second outer slotted track;

a first webbing disposed in the first outer slotted track;

a second webbing disposed in the second outer slotted track;

a middle webbing disposed in the middle slotted track;

wherein the first outer slotted track, the second outer slotted track, and the middle slotted track each independently have a slot width of 2 millimeters to 25 millimeters; wherein the first webbing, the second webbing, and the middle webbing each independently have a width of 3 millimeters to 90 millimeters, and a thickness of 1 millimeter to 5 millimeters; and wherein wherein the first webbing, the second webbing, and the middle webbing each independently comprise nylon, polypropylene, polyester, or a combination thereof;

wherein the slotted tracks and the webbings provide a pull resistance of 30 to 200 newtons, wherein the pull resistance is determined by pulling a 0.1 meter long section of webbing from the slotted track having a slot with a slot width in a direction perpendicular to a longitudinal axis of the slot;

a cover attached to each of the first, second, and middle webbings and disposed on each of the first outer, second outer, and middle slotted tracks;

a first roller disposed at a first end of the first outer, second outer, and middle slotted tracks and connected to a first end of the first, second, and middle webbings;

a second roller disposed at a second opposite end of the first outer, second outer, and middle slotted tracks and connected to a second end of the first, second, and middle webbings;

a first outer bracket disposed on the first webbing and comprising a first guide roller, wherein the first guide roller is an angled guide roller angled away from a center of the retractable awning or is a slanted guide roller having a large roller end with a maximum diameter and a small roller end with a minimum diameter, wherein the small roller end is facing an outer edge of the cover;

a second outer bracket disposed on the second webbing and comprising a second guide roller, wherein the second guide roller is a second angled guide roller angled away from the center of the retractable awning or is a second slanted guide roller having a second large roller end with a second maximum diameter and a second small roller end with a second minimum diameter, wherein the second minimum roller end is facing an opposite outer edge of the cover;

a middle bracket disposed on the middle webbing and comprising a middle guide roller, wherein the middle guide roller is aligned with the retractable awning; and a motor configured to wind and unwind the retractable awning.

* * * * *